US006116872A

United States Patent [19]

Takeshita et al.

[11] Patent Number: 6,116,872

[45] Date of Patent: Sep. 12, 2000

[54] RIPPLE REDUCING DEVICE

[75] Inventors: Seiichiro Takeshita, Tsuchiura; Eiichi Kojima, Yokohama, both of Japan

[73] Assignee: Hitachi Construction Machinery Co., LTD, Tokyo, Japan

[21] Appl. No.: 09/200,973

[22] Filed: Nov. 30, 1998

Related U.S. Application Data

[63] Continuation of application No. PCT/JP98/01494, Apr. 1, 1998.

[30] Foreign Application Priority Data

Feb. 4, 1997 [JP] Japan ..... 9-083681

[51] Int. Cl.[7] ..... F04B 11/00; F16L 55/04

[52] U.S. Cl. ..... 417/543; 137/565.34; 138/26

[58] Field of Search ..... 417/540, 543; 137/565.34; 138/26

[56] References Cited

U.S. PATENT DOCUMENTS

| | | | |
|---|---|---|---|
| 1,777,891 | 10/1930 | Pearson | 417/543 |
| 2,100,404 | 11/1937 | Mason et al. | 138/26 X |
| 2,256,370 | 9/1941 | Adams | 417/543 |
| 2,936,041 | 5/1960 | Sharp et al. | 417/540 X |
| 4,285,534 | 8/1981 | Katayama et al. | 138/26 X |
| 4,448,217 | 5/1984 | Mercier | 138/30 |
| 4,514,151 | 4/1985 | Anders et al. | 417/540 |
| 4,679,597 | 7/1987 | Stein | 138/26 |
| 5,094,271 | 3/1992 | Fritz et al. | 138/26 X |
| 5,096,400 | 3/1992 | Budecker et al. | 417/540 |
| 5,915,929 | 6/1999 | Falk et al. | 417/540 X |
| 5,957,664 | 9/1999 | Stolz et al. | 417/540 X |

FOREIGN PATENT DOCUMENTS

| | | | |
|---|---|---|---|
| 52-43104 | 4/1977 | Japan | 417/540 |
| 60-40720 | 3/1985 | Japan . | |
| 60-43423 W | 3/1985 | Japan . | |
| 3-107594 | 5/1991 | Japan . | |
| 7-269433 | 10/1995 | Japan . | |
| 8-14469 | 1/1996 | Japan . | |

*Primary Examiner*—Tony M. Argenbright
*Attorney, Agent, or Firm*—Oliff & Berridge, PLC

[57] ABSTRACT

A ripple reducing device of the present invention for reducing ripple of oil flowing through a hydraulic line includes a closed line that diverges from the hydraulic line and is closed at a terminal end thereof, and at least one restrictor that divided the interior of the closed line into a plurality of sections, between a branch point at which the closed line diverges from the hydraulic line, and the terminal end of the closed line.

9 Claims, 11 Drawing Sheets

RIPPLE REDUCING DEVICE

This is a continuation of International Application No. PCT/JP98/01494 filed Apr. 1, 1998. The entire disclosure of the prior application is hereby incorporated by reference herein in its entirety.

TECHNICAL FIELD

The present invention relates to ripple reducing devices that reduce ripple or pulsation of a fluid in a line that transmits hydraulic pressure.

BACKGROUND ART

Ripple reducing devices for reducing ripple of a fluid flowing in a hydraulic line are known. For example, an apparatus as disclosed in Japanese laid-open Patent Publication No. 60-40720 is adapted to reduce suction noise or sound that arises when secondary air is introduced into an engine of a motor vehicle. This apparatus includes a silencer or noise eliminator provided on the upstream side of a check valve of a secondary air passage communicating with a secondary air supply port of an exhaust system, for eliminating a frequency component in a certain range, and an auxiliary silencer for eliminating frequency components other than the above frequency component. In this auxiliary silencer, a plurality of closed pipes whose lengths are one fourth of the wavelengths of the frequency components to be eliminated are formed so as to protrude from a side wall of the secondary air passage. Thus, the ripple can be effectively reduced by providing a plurality of closed pipes that correspond to a plurality of frequency components contained in the ripple.

In the known apparatus as described above, since desired noise eliminating effects are obtained by providing the plural closed pipes whose lengths are one fourth of the wavelengths of the frequency components to be eliminated, the required number of closed pipes is increased with an increase in the number of frequency components to be eliminated, resulting in increased complexity and size of the apparatus.

If the ripple reducing device simply consists of a single closed pipe, the transmission loss takes its relative (or local) maximum values at frequencies that are odd multiples of ¼ wavelength resonance mode frequency that is determined by, for example, the shape of the closed pipe, and therefore harmonics that are even multiples of the resonance mode frequency cannot be effectively reduced. Namely, the ripple reducing device consisting of a single closed pipe cannot effectively reduce the fundamental wave of the ripple and its secondary, tertiary and higher harmonics at the same time.

DISCLOSURE OF THE INVENTION

An object of the present invention is to provide a small-sized ripple reducing device capable of reducing ripple of a fluid flowing through a hydraulic line.

To accomplish the above object, the present invention provides a ripple reducing device for reducing ripple of oil flowing through a hydraulic line, comprising a closed line that diverges from the hydraulic line and is closed at a terminal end thereof, and at least one restrictor that divides an interior of the closed line into a plurality of sections, between a branch point from which the closed line diverges, and the terminal end of the closed line.

BEST MODE FOR CARRYING OUT THE INVENTION

First Embodiment

Figure 1:
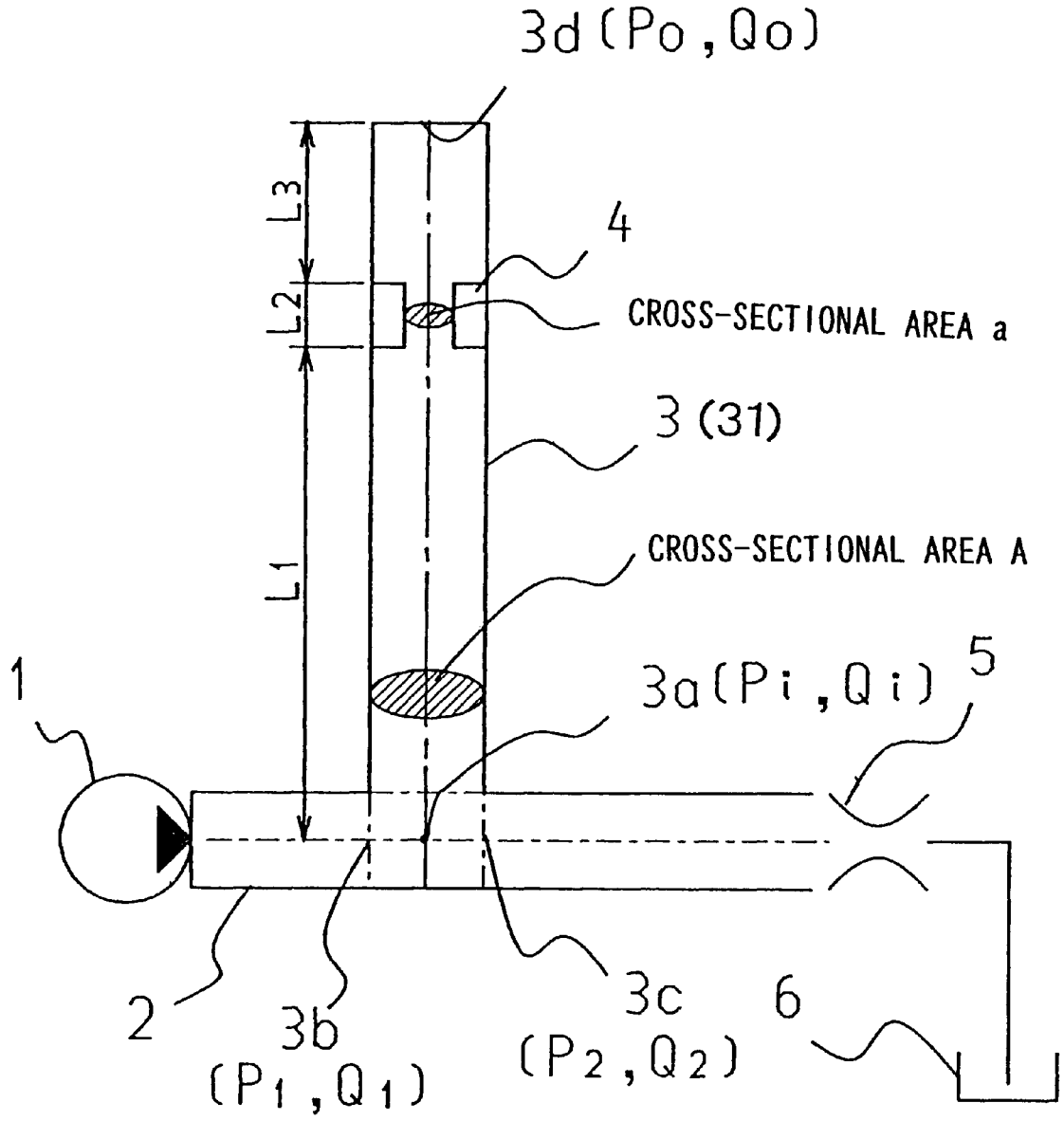
FIG. 1 is a view showing the principle of a ripple reducing device of the first embodiment.
Figure 2A:
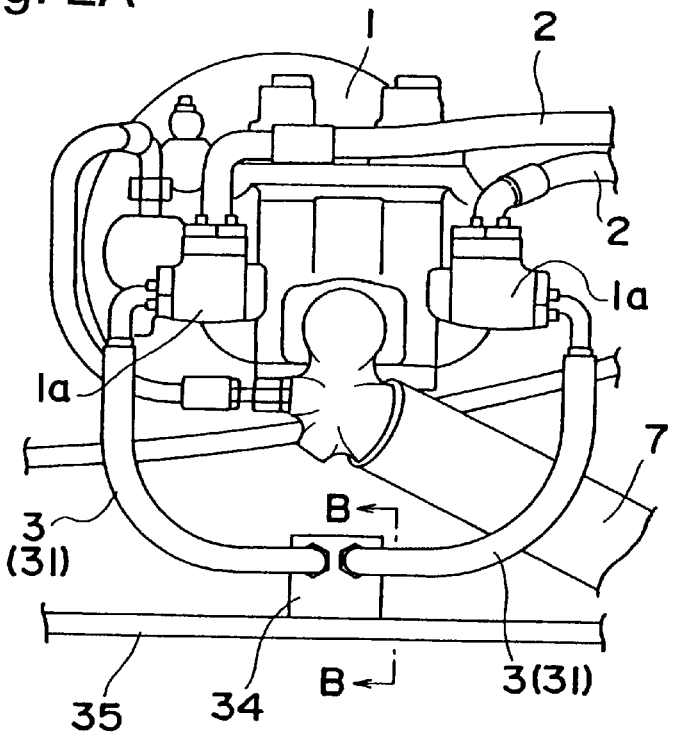
FIG. 2A is a view showing the whole construction of the ripple reducing device of the first embodiment.
Figure 2B:
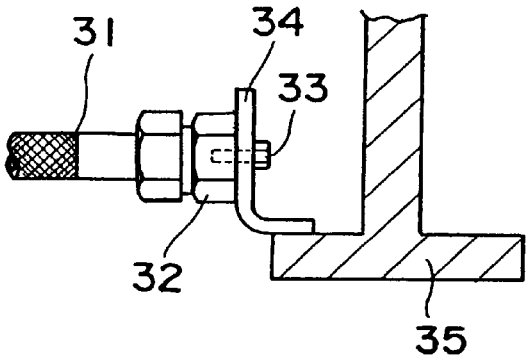
FIG. 2B is a view showing a terminal end portion of a rubber hose.
Figure 2C:
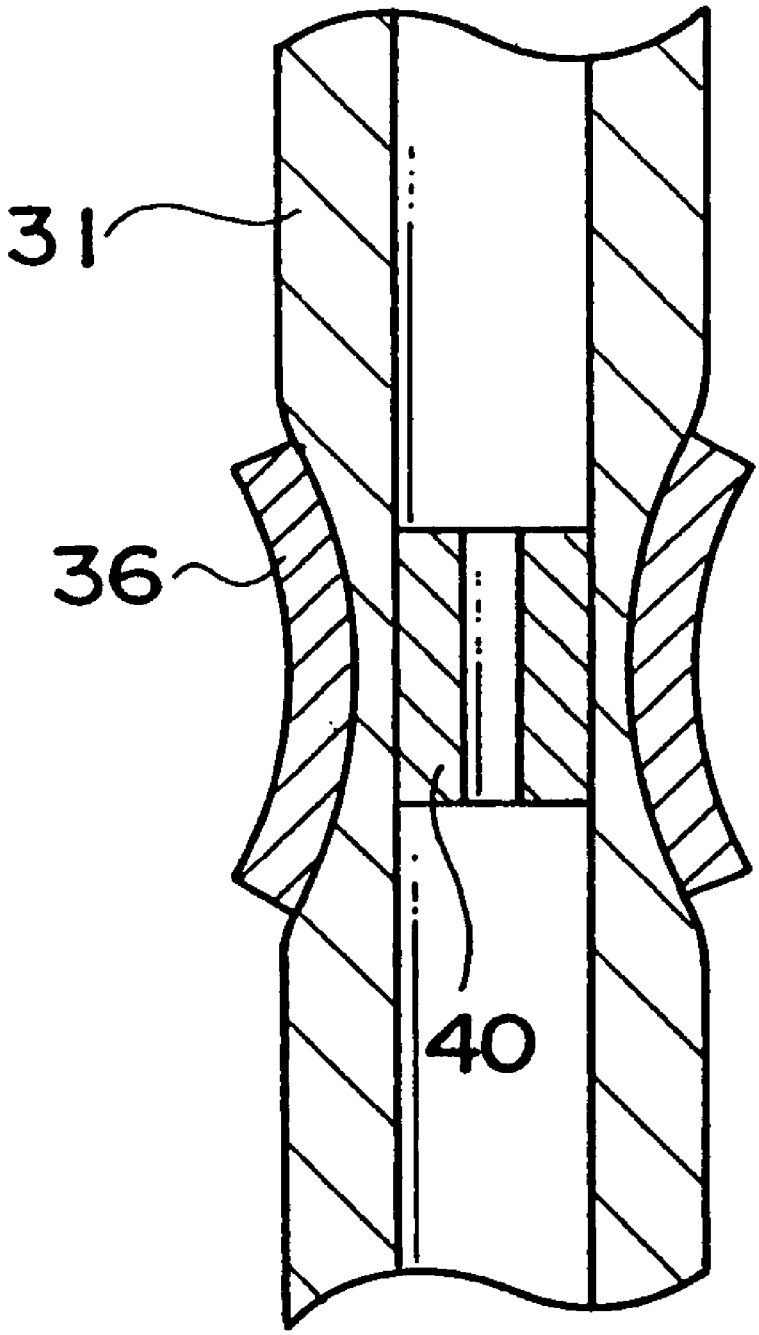
FIG. 2C is a cross-sectional view showing a restrictor portion.
Figure 3:
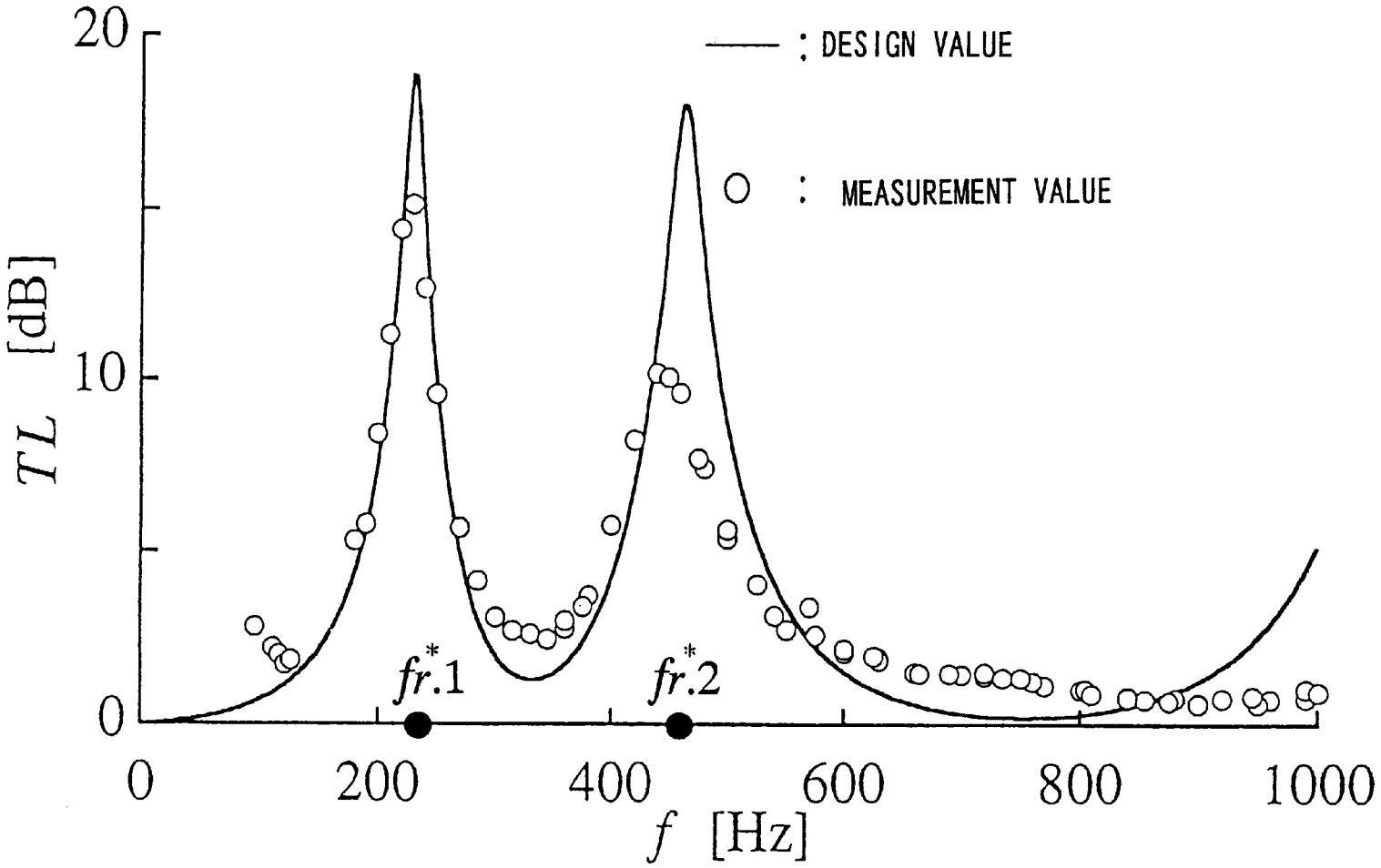
FIG. 3 is a graph showing design values and actual measurement values of the transmission loss when the ripple reducing device of the first embodiment is used.

Referring to FIG. 1 through FIG. 3, a ripple reducing device according to the first embodiment of the present invention will be described.

FIG. 1 is a view useful in explaining the principle of the device of the first embodiment, in which reference numeral 1 denotes a hydraulic pump, 2 denotes a main line or pipe that leads a hydraulic fluid or oil discharged from the hydraulic pump 1, 3 denotes a side branch (closed line) in the form of a rubber hose that diverges from the main line 2, 5 denotes a restrictor, such as a control valve, as a typical hydraulic component, and 6 denotes a hydraulic oil tank.

As shown in FIG. 1, the side branch 3 is connected at its start end 3*a* to the main line 2, and closed at its distal or terminal end 3*d* to provide a closed end. A restrictor 4 made of a metal is provided inside the side branch 3, such that the side branch is divided by the restrictor 4 into two sections on the sides of the start end 3*a* and terminal end 3*b*.

In FIG. 1, L1 is the length from the axis or center of the main line 2 to the lower end (in FIG. 1) of the restrictor 4, L2 is the length between the upper and lower ends of the restrictor 4, L3 is the length from the upper end of the restrictor 4 to the terminal end 3*d* of the side branch 3, "A" is the cross-sectional area of an inner bore of the side branch 3, and "a" is the cross-sectional area of an aperture of the restrictor 4. Where Pi and Qi represent pressure ripple and flow ripple, respectively, arising at the start end 3*a* of the side branch 3, and Po and Qo represent pressure ripple and flow ripple, respectively, arising at the terminal end 3*d*, the relationship as given by the expression (1) below is established between these ripples. The matrices of the first, second and third terms of the right side of the expression (1) correspond to transfer matrices of the section of the side branch 3 having the length L1, restrictor portion 4 having the length L2 between its upper and lower ends, and the section of the branch having the length L3, respectively. The transfer matrix of the restrictor 4 in the second term is simplified, assuming that the length L2 is sufficiently shorter than the wavelength of ripple.

$$\begin{pmatrix} P_1 \\ Q_1 \end{pmatrix} = \begin{pmatrix} \cosh\{\beta(s)L_1\} & Z_0\sinh\{\beta(s)L_1\} \\ \frac{1}{Z_0}\sinh\{\beta(s)L_1\} & \cosh\{\beta(s)L_1\} \end{pmatrix} \times \begin{pmatrix} 1 & \frac{\rho L_2 \xi_0(s)^2}{a}s \\ 0 & 1 \end{pmatrix} \times \begin{pmatrix} \cosh\{\beta(s)L_3\} & Z_0\sinh\{\beta(s)L_3\} \\ \frac{1}{Z_0}\sinh\{\beta(s)L_3\} & \cosh\{\beta(s)L_3\} \end{pmatrix} \times \begin{pmatrix} P_0 \\ Q_0 \end{pmatrix} \quad (1)$$

Here, β(s) is the wave propagation coefficient of the fluid in the line, $Z_0$ is the characteristic impedance ($=\rho c \xi_P(s) / A$) of the line, ρ is the density of the fluid, c is the sound velocity in the fluid in the line, $\xi_P(s)$ is a coefficient of the resistance based on the viscosity of the fluid in the line, and $\xi_0(s)$ is a coefficient of the resistance based on the viscosity of the fluid in the restrictor.

If Pi and Qi are obtained from the above expression (1) in which the flow ripple Qo at the terminal end 3*d* of the side: branch 3 is equal to zero (since the terminal end 3*d* is a closed end), the impedance Zs of the side branch 3 is given by the expression (2) as follows.

$$Z_s = \frac{P_i}{Q_i} = \left( \frac{1 + \left[ \frac{\rho L_2 \xi_0(s)^2 s}{Z_0 a} + \tanh\{\beta(s)L_1\} \right] \tanh\{\beta(s)L_3\}}{\tanh\{\beta(s)L_1\} + \left[ \frac{\rho L_2 \xi_0(s)^2 s}{Z_0 a} \tanh\{\beta(s)L_1\} + 1 \right] \tanh\{\beta(s)L_3\}} \right) Z_0 \quad (2)$$

Where P1, Q1 represent the pressure ripple and flow ripple, respectively, arising at an inlet 3*b* of the main line 2 when the side branch 3 is installed so as to diverge from the main line 2, and P2 and Q2 represent the pressure ripple and flow ripple, respectively, arising at an outlet 3*c* (FIG. 1) of the main line 2, while T represents the transfer matrix, the relationship as expressed by the following expression (3) is established.

$$\begin{pmatrix} P_1 \\ Q_1 \end{pmatrix} = \begin{pmatrix} T_{11} & T_{12} \\ T_{21} & T_{22} \end{pmatrix} \begin{pmatrix} P_2 \\ Q_2 \end{pmatrix} \quad (3)$$

Since the relationships P1=Pi=P2, Q1=Qi+Q2 are established , t he respective coefficients of the transfer matrix T are determined as $T_{11}=1$, $T_{12}=0$, $T_{21}=1/Zs$, $T_{22}$32 1, using the relationship Qi=Pi/Zs obtained from the expression (2).

When the side branch 3 is connected to the main line 2 having a characteristic impedance Zc to diverge therefrom, the transmission loss TL is give n by the following expression (4), using the coefficients of the transfer matrix T. This expression (4) is derived from known formulas in the fields of transmission engineering or acoustic engineering.

$$TL = 20 \cdot \log\left[ \frac{1}{2} \left\{ \left| T_{11} + \frac{1}{Z_c} T_{12} + Z_c T_{21} + T_{22} \right| \right\} \right] \quad (4)$$

If the respective coefficients of the transfer matrix T as indicated above are substituted into the above expression (4), the transmission loss TL is expressed in terms of the lengths L1, L3 of the line, cross-sectional area "A", length L2 of the restrictor, and the cross-sectional area "a". Accordingly, the transmission loss TL can be set to the relative maximum at desired frequencies by changing the lengths L1, L3 of the line, cross-sectional area "A", length L2 of the restrictor, and the cross-sectional "a" to various values.

In the ripple reducing device of the first embodiment, the transmission loss can be set to its relative maximum values at two certain frequencies, by controlling the lengths L1, L3 of the line, cross sectional area "A", length L2 of the restrictor, and cross sectional area "a" to given values, according to the above-indicated expression (4) and the respective coefficients of the matrix T. Namely, the transmission loss of the conventional side branch takes its relative maximum values only at frequencies that are odd multiples of the ¼ wavelength resonance mode frequency, whereas the transmission loss may take its relative maximum values at desired frequencies in the ripple reducing device of the first embodiment, by determining parameters, such as line lengths and cross sectional areas of the side branch 3 on the basis of the above expressions (1) through (4). For example, the transmission loss may be set to take its relative maximum values at the primary and secondary, or secondary and tertiary frequencies of the hydraulic ripple.

To relatively (or locally) maximize the transmission loss TL at desired frequencies, the line lengths L1, L3, cross sectional are "A", restrictor length L2, cross sectional area "a" and other parameters may be obtained by a computer that performs the calculation as given by the above expression (4), while varying these values. Also, they are obtained by actually measuring the transmission loss in repeated experiments in which a variety of trial side branches are manufactured. The side branch may be efficiently designed with high accuracy, by combining simulation with the help of a computer and actual measurement conducted in an experiment.

Suppose the length L1 is 770 mm, L3 is 210 mm, cross-sectional area "A" is 283.5 $mm^2$, length L2 of the restrictor 4 in the side branch is 52 mm, and the cross sectional area "a" is 12.6 $mm^2$. If these values are substituted into the above expressions (1) through (4), relative maximum values of the transmission loss appear at f*r.1=230 Hz, and f*r.2=460 Hz, as indicated by the solid line (design values) in FIG. 3. In this case, if the fundamental frequency of the hydraulic vibrations (ripple or pulsation) is 230 Hz, the single side branch 3 is able to effectively reduce vibrations up to the secondary harmonic.

In the first embodiment, the side branch 3 consists of a rubber hose. In the meantime, points "O" plotted in FIG. 3 indicate measurement values actually obtained with the above parameters, which values deviate from the design values indicated by the solid line. The deviation mainly result from caulking or fastening of the rubber hose, and reduction in the cross-sectional area at joint portions of the hose. If the side branch is designed in view of these aspects, the deviation may be almost eliminated.

In the first embodiment as described above, the restrictor 4 is provided inside the side branch 3, so that the impedance Zs of the side branch 3 can be relatively minimized, namely, the transmission loss of the side branch 3 can be relatively maximized, at desired two frequencies, by adjusting the reflection coefficient (or transmission coefficient) determined by the inertia effect (ρL2/a) of the fluid in the restrictor portion 4, and the line lengths on the opposite sides of the restrictor 4. Thus, only one side branch (closed line) is able to provide desired ripple or vibration reducing characteristics in accordance with the frequency distribution of the ripple.

Furthermore, the ripple reducing device of the first embodiment has a simple structure, and thus ensures improved reliability and reduced cost, as compared with a ripple reducing device including a plurality of side branches.

FIG. 2 shows an example of installation of the ripple reducing device of the first embodiment that is suitable for reducing ripple of a hydraulic pump. As shown in FIG. 2A, oil discharged from the hydraulic pump 1 is supplied to a control valve, or the like, through the main line (delivery hose) 2. The main line 2 is connected at one end thereof to a block la which is provided on a delivery port of the hydraulic pump 1, and a rubber hose 31 as the side branch 3 is connected at one end thereof to the block 1*a*. As shown in FIG. 2B, the other end of the rubber hose 31 is closed by a blind plug 32, which in turn is attached, via a bolt 33, to a bracket 34 that is fixed to a main frame 35. The rubber hose 31, or side branch, diverges from the main line 2, through a conduit within the block la, so that the hose 31 and the main line 2 communicate with each other. Reference numeral 7 denotes a suction line.

As shown in FIG. 2C, a restrictor 40 made of a metal is inserted midway the rubber hose 31. The restrictor 40 is fastened by a caulked ring 36 from the outside of the rubber 31, and thus fixed in position.

Second Embodiment

Figure 4:
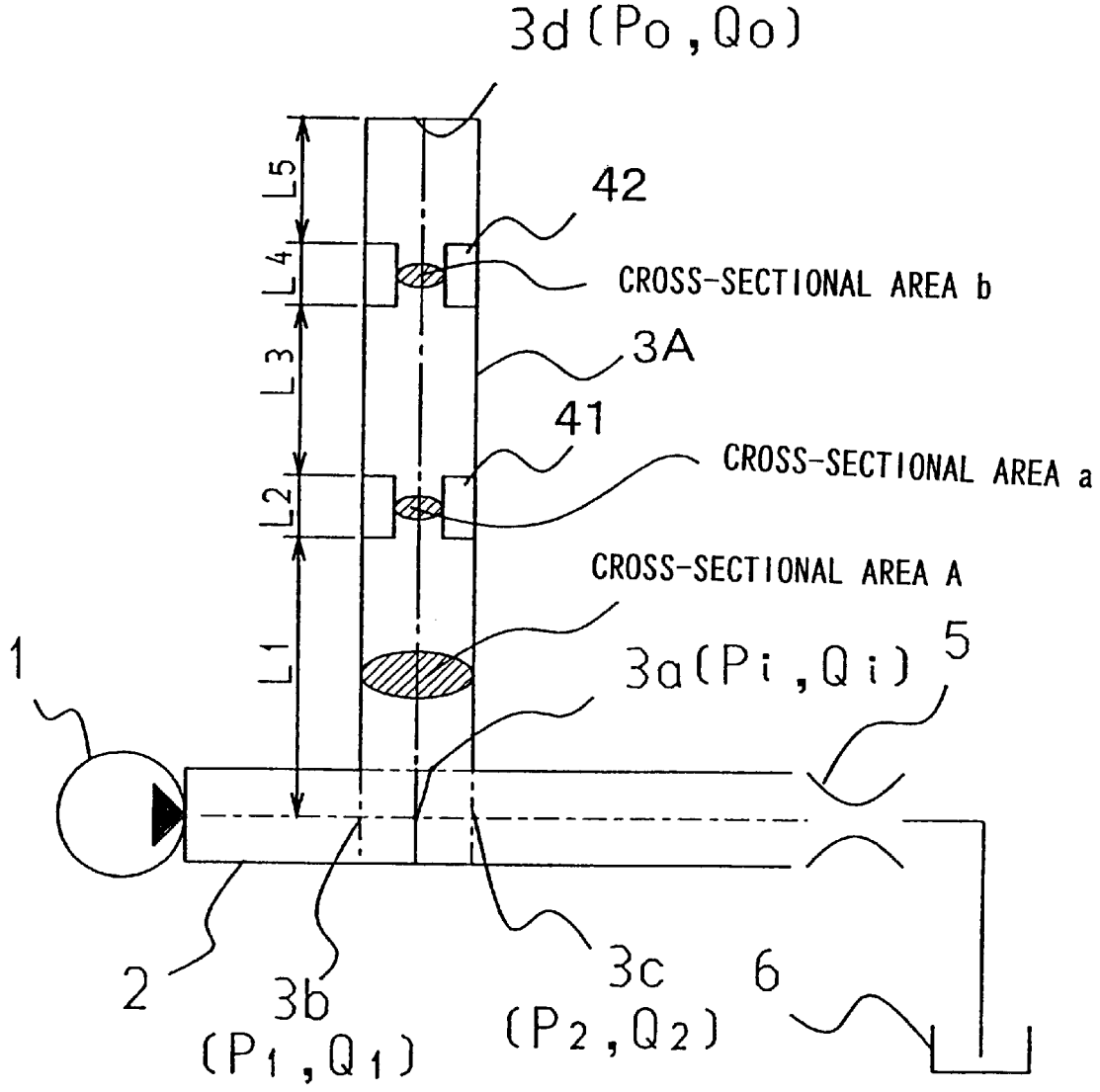
FIG. 4 is a view showing the principle of a ripple reducing device of the second embodiment.
Figure 5:
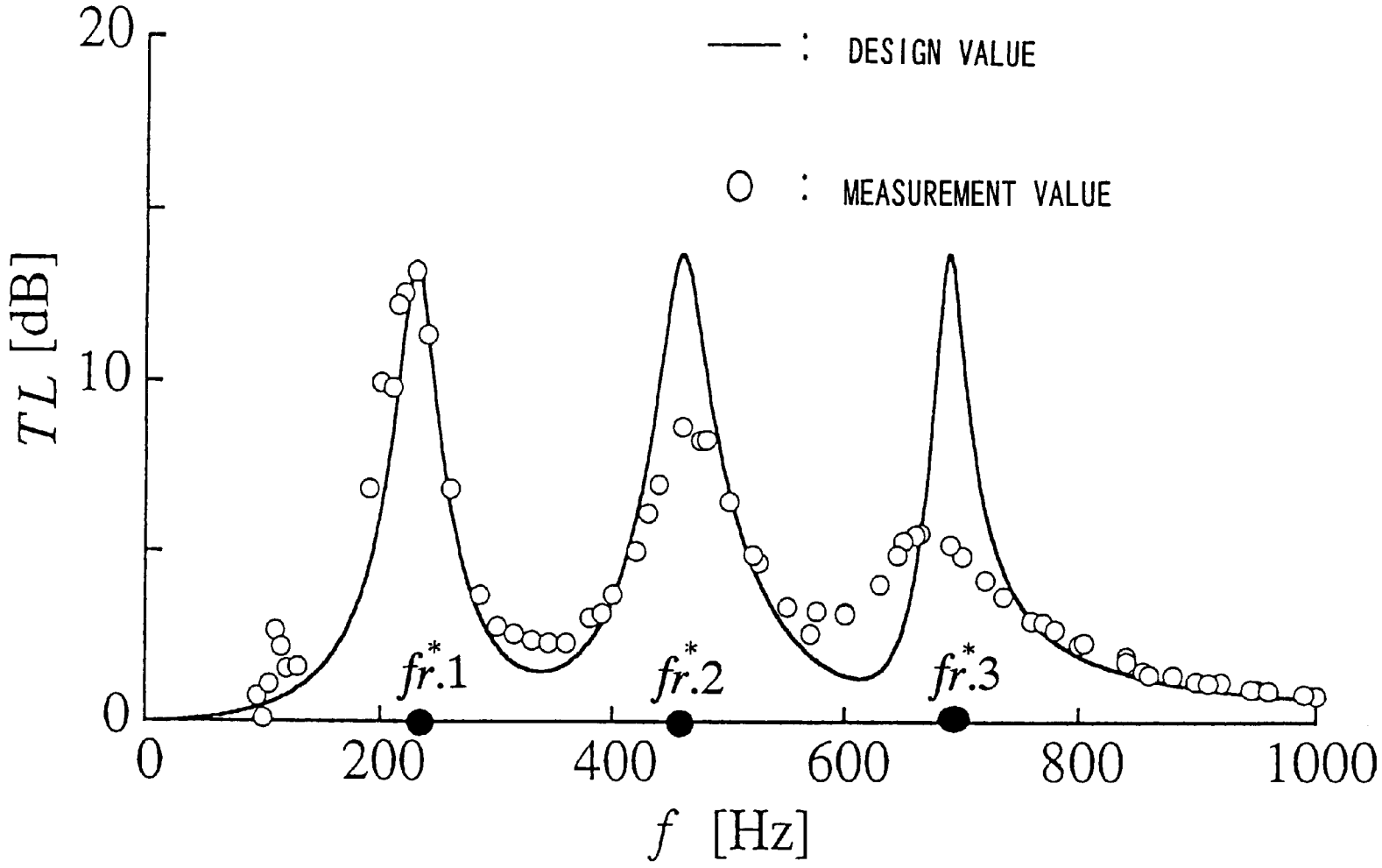
FIG. 5 is a graph showing design values and actual measurement values of the transmission loss when the ripple reducing device of the second embodiment is used.

Referring to FIG. 4 and FIG. 5, a ripple reducing device according to the second embodiment of the present invention will be described.

As shown in FIG. 4, two restrictors 41 and 42 are provided in one side branch 3A in the device of the second embodiment. In FIG. 4, L1 is the length from the axis or center of the main line 2 to the lower end (in FIG. 4) of the restrictor 41, L2 is the length between the upper and lower ends of the restrictor 41, L3 is the length from the upper end of the restrictor 41 to the lower end (in FIG. 4) of the restrictor 42, L4 is the length between the upper and lower ends of the restrictor 42, L5 is the length from the upper end of the restrictor 42 to the terminal end 3*d* of the side branch 3A, "A" is the cross-sectional area of an inner bore of the side branch 3A, "a" is the cross-sectional area of an aperture of the restrictor 41, and "b" is the cross-sectional area of an aperture of the restrictor 42. Where Pi and Qi represent pressure ripple and flow ripple, respectively, arising at the start end 3*a* of the side branch 3A, and Po and Qo represent pressure ripple and flow ripple, respectively, arising at the terminal end 3*d*, the relationship given by the expression (5) below is established between these ripples.

$$\begin{pmatrix} P_1 \\ Q_1 \end{pmatrix} = \begin{pmatrix} \cosh\{\beta(s)L_1\} & Z_0\sinh\{\beta(s)L_1\} \\ \frac{1}{Z_0}\sinh\{\beta(s)L_1\} & \cosh\{\beta(s)L_1\} \end{pmatrix} \times \begin{pmatrix} 1 & \frac{\rho L_2 \xi_0(s)^2}{a}s \\ 0 & 1 \end{pmatrix} \times \begin{pmatrix} \cosh\{\beta(s)L_3\} & Z_0\sinh\{\beta(s)L_3\} \\ \frac{1}{Z_0}\sinh\{\beta(s)L_3\} & \cosh\{\beta(s)L_3\} \end{pmatrix} \times \begin{pmatrix} 1 & \frac{\rho L_1 \xi_0(s)^2}{b}s \\ 0 & 1 \end{pmatrix} \times \begin{pmatrix} \cosh\{\beta(s)L_6\} & Z_0\sinh\{\beta(s)L_6\} \\ \frac{1}{Z_0}\sinh\{\beta(s)L_6\} & \cosh\{\beta(s)L_6\} \end{pmatrix} \times \begin{pmatrix} P_0 \\ Q_0 \end{pmatrix} \quad (5)$$

The transmission loss TL can be calculated by deriving an expression similar to the expression (4), based on the above expression (5).

In the case where the length L1 is 615 mm, L2 is 26 mm, L3 is 186 mm, L4 is 42 mm, L5 is 108 mm, cross sectional area "A" is 283.5 $mm^2$, cross sectional area "a" is 12.6 mm, and the cross sectional area "b" is 7.1 $mm^2$, relative maximum values of the transmission loss appear at f*r.1=230 Hz, f*r.2=460 Hz, and f*r.3=690 Hz, as indicated by the solid line (design values) in FIG. 5. In this case, if the fundamental frequency of the hydraulic vibrations (ripple) is 230 Hz, the single side branch 3A is able to effectively reduce vibrations of the primary, secondary and tertiary harmonics.

In the second embodiment, the side branch 3A consists of a rubber hose. While points "O" in FIG. 5 represent actual measurement values, these measurement values deviate from the design values in a high frequency region, for the same reasons as given in the first embodiment.

Third Embodiment

The present embodiment will be described with reference to FIG. land FIG. 6. The third embodiment employs a side branch in the form of a steel pipe, in place of the rubber hose of the device of the first embodiment. In the following, the same reference numerals as used in the first embodiment are used for identifying the same constituent elements, of which detailed description will not be provided.

In FIG. 1, suppose the length L1 is 990 mm, L3 is 250 mm, cross-sectional area "A" is 295.6 $mm^2$, length L2 of the restrictor 4 provided inside the side branch is 55 mm, and the cross sectional area "a" is 12.6 $mm^2$. If these values are substituted into the above expressions (1) through (4), relative maximum values of the transmission loss appear at f*r.1=250 Hz and f*r.2=500 Hz, as indicated by the solid line (design values) in FIG. 6.

Figure 6:
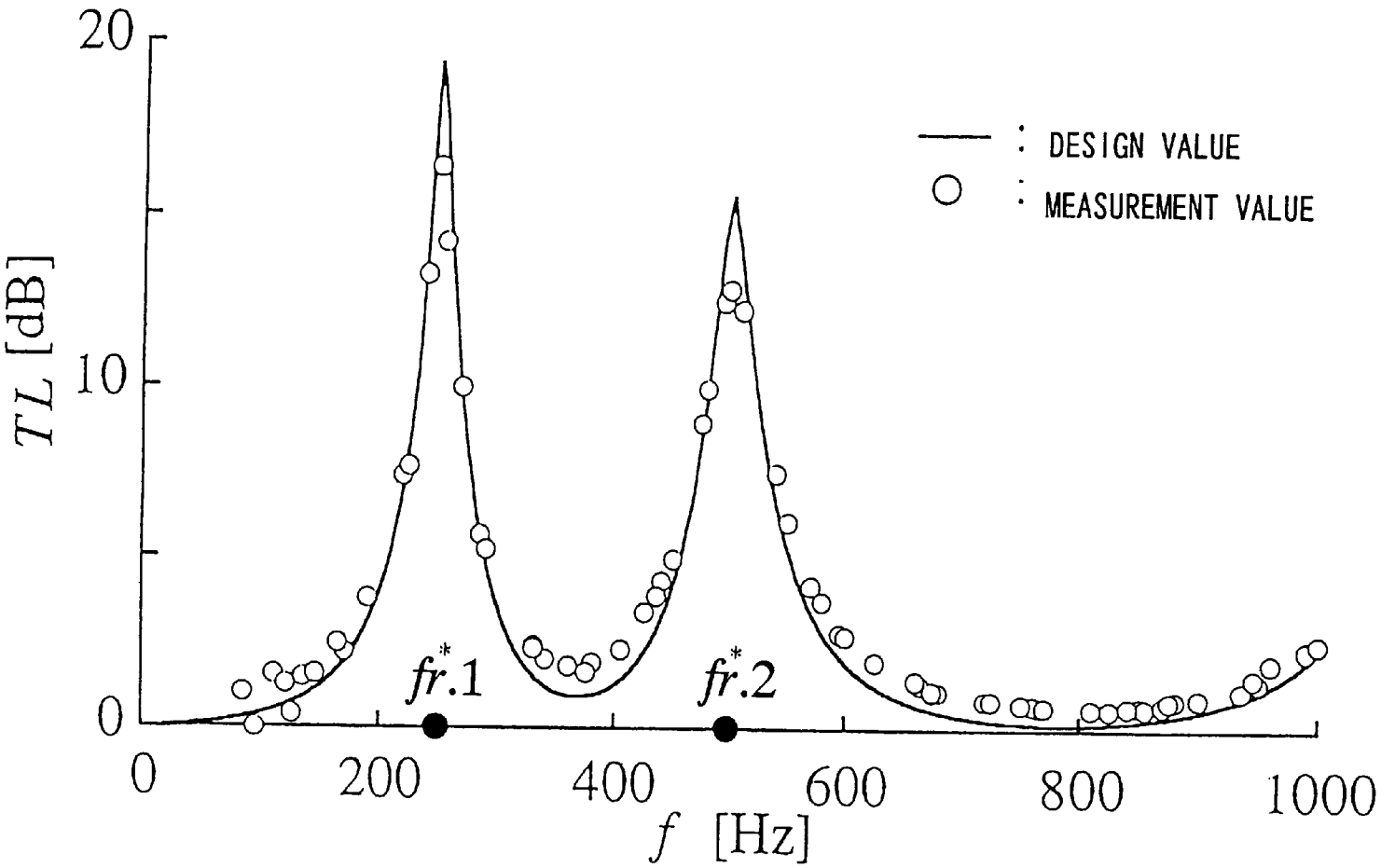
FIG. 6 is a graph showing design values and actual measurement values of the transmission loss when the ripple reducing device of the third embodiment is used.

In the third embodiment, actual measurement values of the transmission loss that are represented by points "O" in FIG. 6 are distributed in close relationship with the design values. This is because the steel pipe has a uniform cross-sectional area over the entire length thereof, and a highly accurate mathematical model relating to the wave propagation characteristics has been established. In the third embodiment, where the fundamental frequency of the hydraulic vibrations is 250 Hz, the fundamental frequency component and its secondary harmonic component can be effectively attenuated.

Fourth Embodiment

The present embodiment will be described with reference to FIG. 4 and FIG. 7. The fourth embodiment employs a side branch in the form of a steel pipe, in place of the rubber hose of the device of the second embodiment. In the following, the same reference numerals as used in the second embodiment are used for identifying the same constituent elements, of which detailed description will not be provided.

Figure 7:
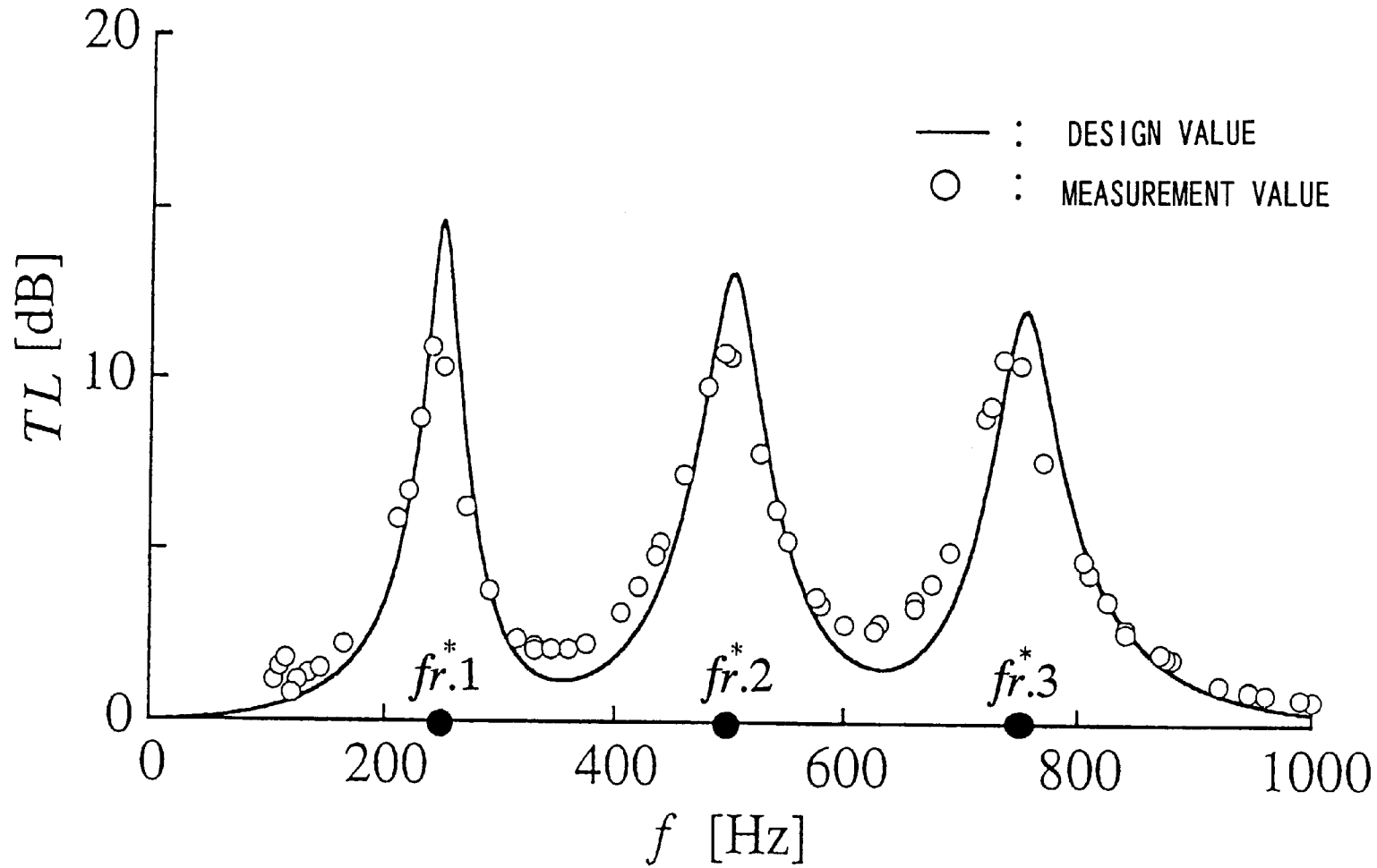
FIG. 7 is a graph showing design values and actual measurement values of the transmission loss when the ripple reducing device of the fourth embodiment is used.

In the case where the length L1 is 738 mm, L2 is 30 mm, L3 is 225 mm, L4 is 48 mm, L5 is 134 mm, cross-sectional area "A" is 295.6 $mm^2$, cross-sectional area "a" is 12.6 $mm^2$, and the cross-sectional area "b" is 7.1 $mm^2$ in FIG. 4, relative maximum values of the transmission loss appear at f*r.1=250 Hz, f*r.2=500 Hz, and f*r.3 =750 Hz, as indicated by the solid line (design values) in FIG. 7.

In the fourth embodiment, actual measurement values of the transmission loss that are represented by points. "O" in FIG. 7 are distributed in close relationship with the design values, because the side branch 3A of the fourth embodiment is formed by a steel pipe which has a uniform cross-sectional area, and for which a highly accurate mathematical model has been established. In the fourth embodiment, where the fundamental frequency of the hydraulic vibrations is 250 Hz, the fundamental frequency component and its secondary and tertiary harmonic components can be effectively attenuated.

While a plurality of lines connected in series with the restrictor(s) 4 (41, 42) interposed therebetween are formed of the same material (rubber hose or steel pipe), the plural lines (hose, pipe or tube) may be formed of mutually different materials. In this case, the frequency characteristics of ripple reduction can be controlled in a wide variety of ways, by changing the combination of materials, so as to provide an increased variety of ripple reduction devices, from which an appropriate one may be selected upon installation in view of desired performance and cost.

While the inside of a single side branch is divided into a plurality of sections by the restrictor(s) in the first through fourth embodiments, the closed line may be constituted by providing a line(s) having a different diameter which is inserted at least two lines so as to provide a choke-type restrictor(s). The ripple reducing device having this arrangement provides a similar effect.

Four or more lines may be connected in series by providing three or more restrictors within one side branch, or by other method. In this case, the number of relative maximum points of the ripple reduction frequency can be increased with an increase in the number of the lines into which the side branch is divided. The ripple reducing device of the present invention may be applied to ripple reduction of other gas or liquid, for example, air pressure or water pressure.

Figures 8A, 8B:
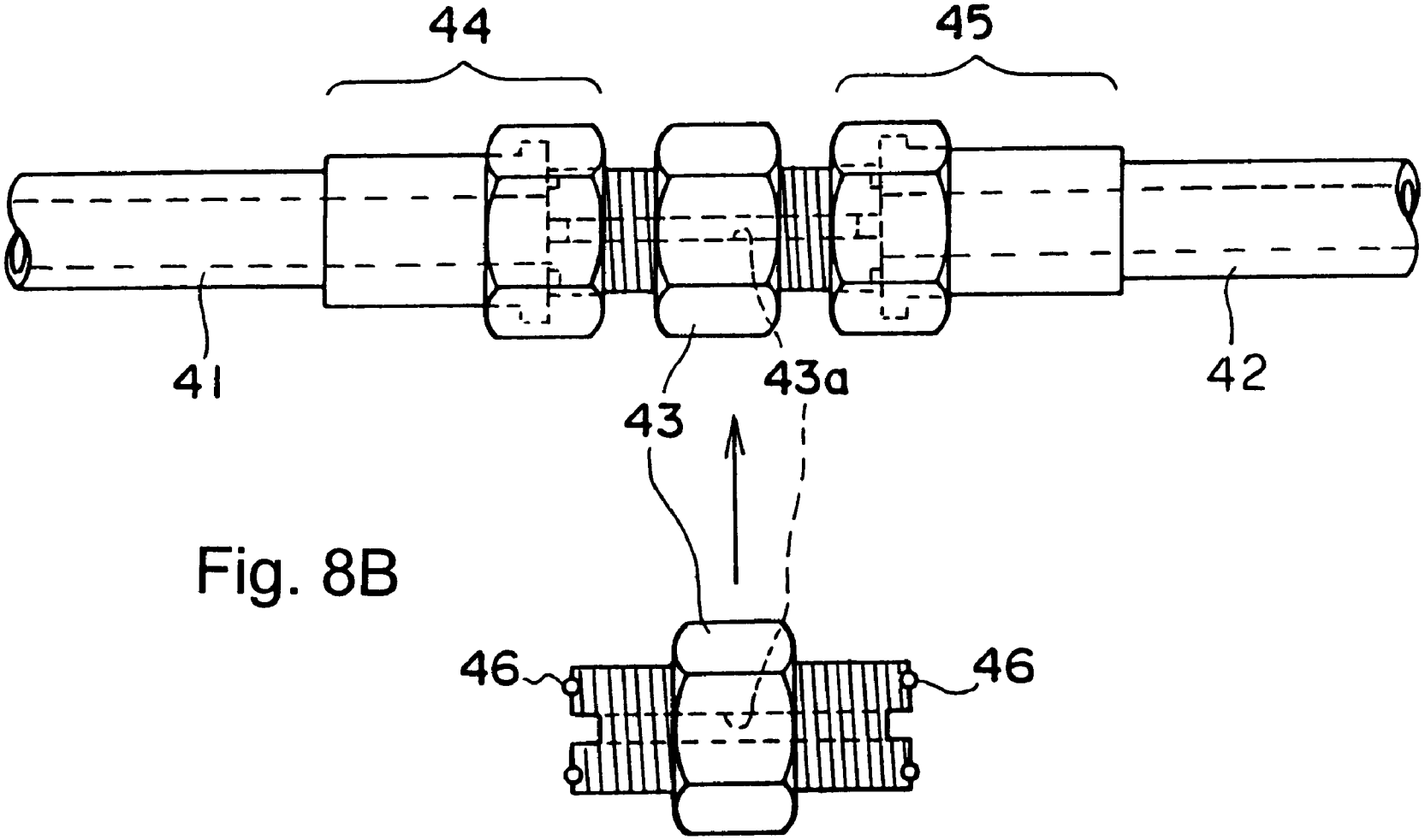
FIGS. 8A, 8B are views showing another example of restrictor.

In the first embodiment as illustrated above, the restrictor 40 made of metal is inserted midway the rubber hose 31, and caulked from the outside of the rubber hose 31, as shown in FIG. 2C. The present invention, however, is not limited to this arrangement. Another example of restrictor is shown in FIGS. 8A and 8B. In FIG. 8A, two rubber hoses 41, 42 are connected by an adapter 43, and a flow restricting portion 43*a* having a reduced cross-sectional area is formed within the adapter 43. The rubber hoses 41, 42 are respectively provided with mouthpieces or connectors 44, 45 that enable the hoses 41, 42 to be connected to the adapter 43. The adapter 43 is provided with O rings 46 for the purpose of sealing. Similarly to FIG. 2A and FIG. 2B, the other end of the rubber hose 41 is connected to the block 1*a*, and the other end of the rubber hose 42 is closed by the blind plug 32, and attached, via the bolt 33, to the bracket 34 fixed to the main frame 35. The rubber hoses 41, 42 may be replaced by steel pipes.

Figures 9A, 9B, 9C:
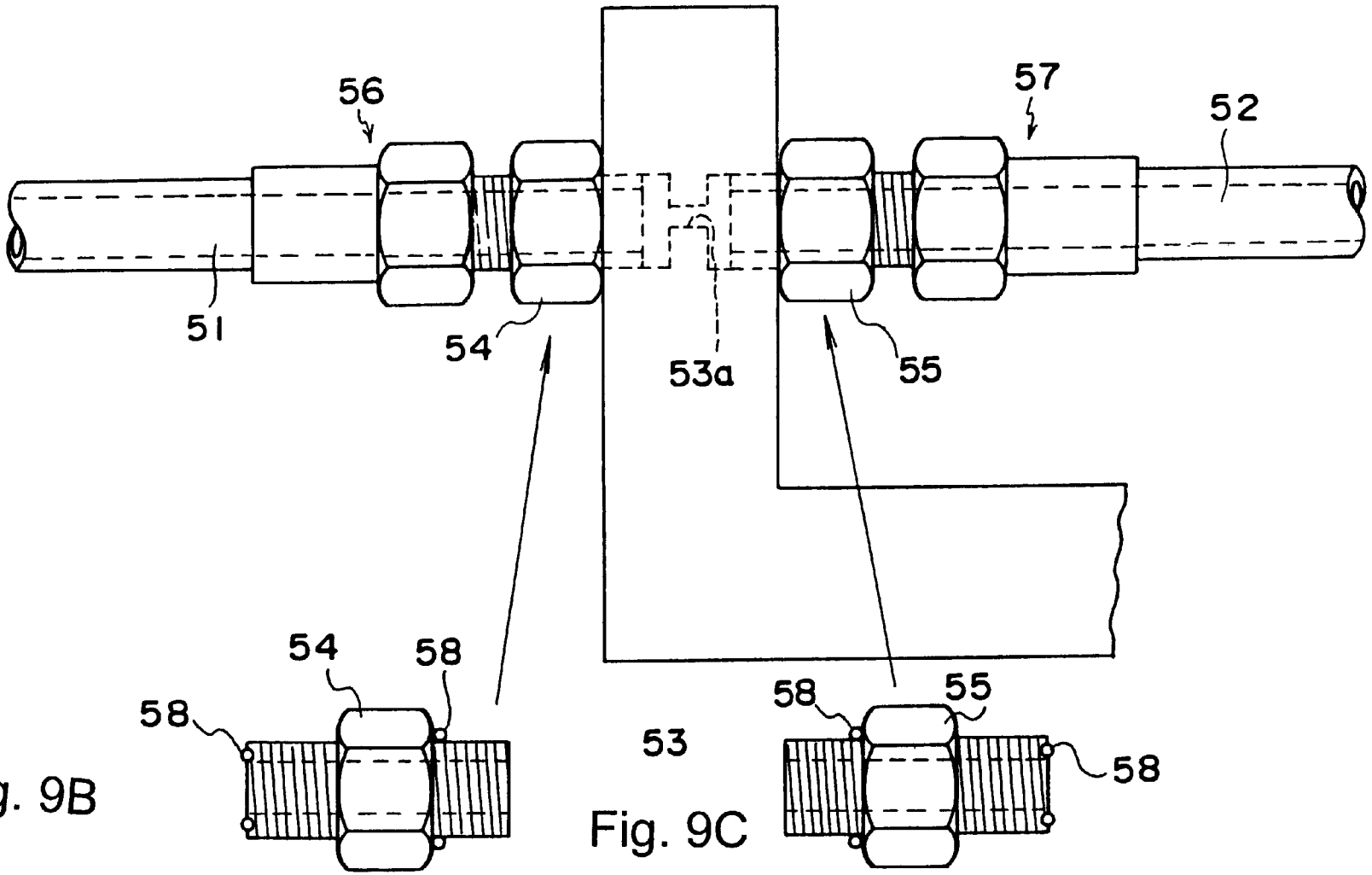
FIGS. 9A–9C are views showing a further example of restrictor.

FIGS. 9A–9C shows a further example of restrictor, in which rubber hoses 51, 52 are joined by a junction bracket 53, with adapters 54, 55 provided between the respective hoses 51, 52 and the bracket 53, and a restrictor 53*a* whose diameter is smaller than the inside diameter of the rubber hoses 51, 52 is formed in the junction bracket 53. The adapters 54, 55 are screwed onto the bracket 53, and the rubber hoses 51, 52 are provided with mouthpieces 56, 57 for connection with the adapters 54, 55. The junction bracket 53 is attached to the main frame. The adapters 54, 55 are provided with O rings 58 for the purpose of sealing. With this arrangement, the side branch as a whole is fixed to the main frame.

Figure 10A:
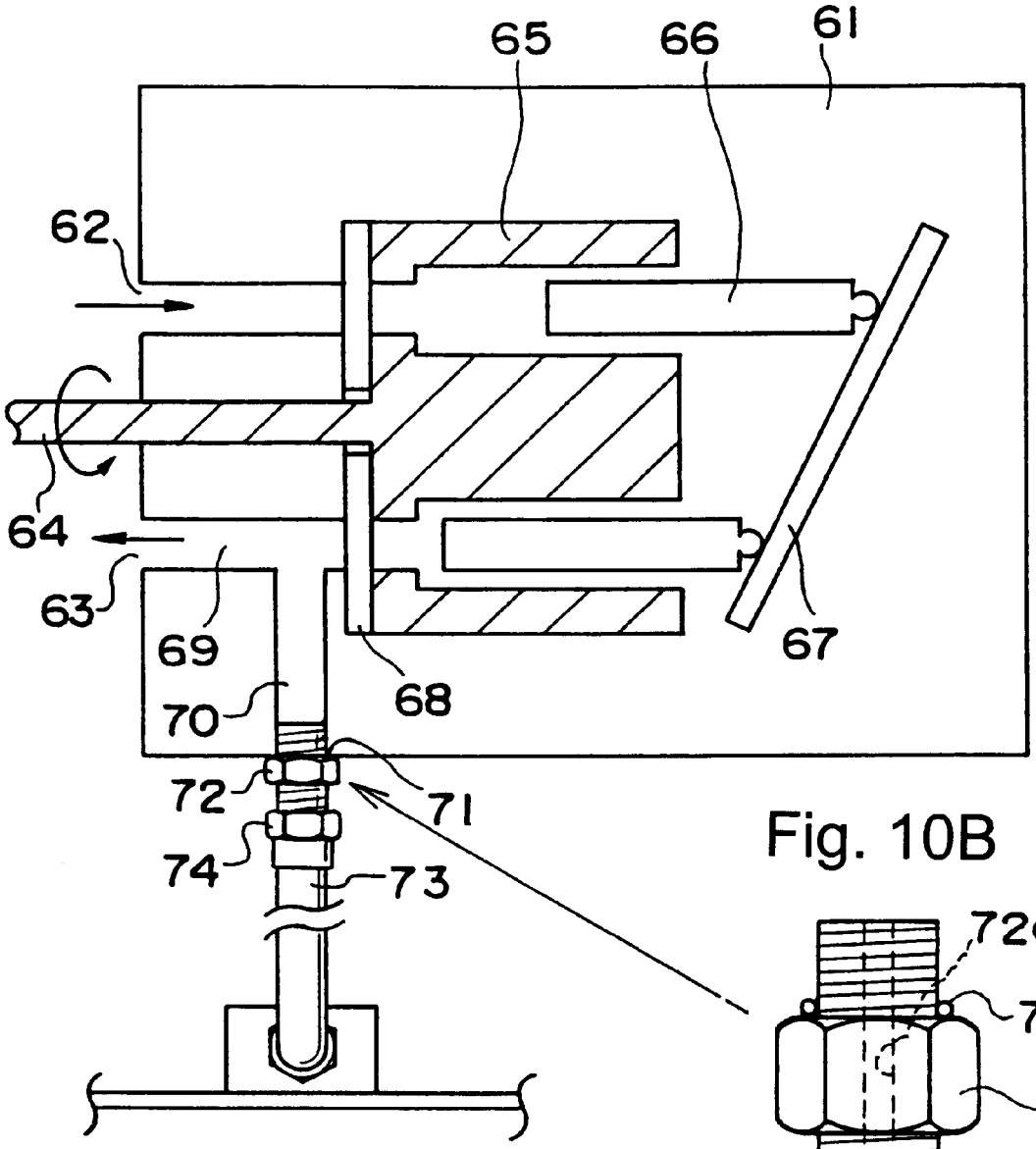
FIGS. 10A, 10B are views explaining the case where a part of a side branch is provided inside a pump.
Figure 10B:
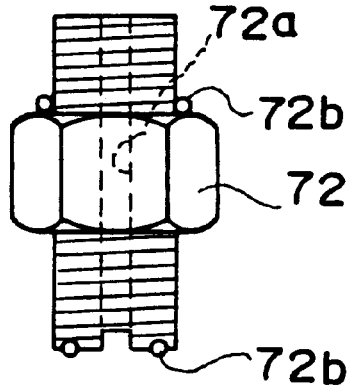

In the first through fourth embodiments, the side branch is located outside the pump. It is, however, to be understood that the present invention, however, is not limited to this arrangement. For example, a portion of the side branch up to the first node where one end of the restrictor is located may be provided inside the pump. FIGS. 10A and 10B are a schematic views showing this arrangement for use with an axial type, swash plate type pump, wherein reference numeral 61 shows the configuration of the pump. The pump 61 includes a cylinder portion 65 that rotates with a rotary shaft 64, and a piston 66 that reciprocates in accordance with the rotation of the cylinder portion 65, with its position being controlled by a swash plate 67, so that oil is introduced through a suction port 62, and discharged through a discharge port 63. Reference numeral 68 denotes a valve plate. In the example of FIG. 10A, a first side branch 70 is provided in the vicinity of the valve plate 68 so as to diverge from a line 69 that leads to the discharge port 63. The first side branch 70 extends from the line 69 to a first side branch outlet 71. An adapter 72 in which a flow restricting portion 72*a* is formed as in the adapter of FIG. 8 is attached to the first side branch outlet 71, and a second side branch 73 is connected to the outer wall of the pump 61 via the adapter 72. A mouthpiece 74 is provided at one end of the second side branch, for connecting the second side branch 73 to the adapter 72. The terminal end of the second side, branch 73 is closed by a blind plug similar to that of FIG. 2B, and fixed to a frame, or the like. The diameter of the restricting portion 72*a* of the adapter 72 is smaller than the inside diameter of the first side branch 70 and second side branch 73. The adapter 72 is provided with O rings 72*b* for the purpose of sealing. If this arrangement is compared with the first embodiment as shown in FIG. 1, the first side branch 70 of FIG. 10A corresponds to the L1 portion of the side branch 3 of FIG. 1, the adapter 72 of FIG. 10A corresponds to the restrictor 4 of FIG. 1, and the second side branch 73 of FIG. 10A corresponds to the L3 portion of the side branch 3 of FIG. 1.

The ripple frequency varies depending upon the rotating speed of the pump 61 and others, and also varies depending upon the conditions under which the pump is used. Thus, the frequency of vibrations to be reduced will vary depending upon these factors. While the length of the first side branch 70 located inside the pump 61 may not be controlled or changed, the diameter of the restricting portion of the adapter 72 attached to the outer wall of the pump 61, the length of the second side branch 73, and so forth, can be suitably controlled so as to achieve reduction of ripple at a desired frequency. Hence, the pump may be produced as common pump by locating a part up to the first restrictor inside the pump, so that the common pump contributes to standardization of pumps equipped with ripple reducing devices, and reduction of cost. The first side branch 70 and second side branch 73 may be rubber hoses or steel pipes, as in the illustrated embodiments.

Ripples or pulsation may be reduced with the highest efficiency if the branch point from which the side branch extends is located at a point corresponding to an antinode of the ripple. It is thus highly efficient to position the side branch as close as possible to the valve plate, as in the example of FIGS. 10A and 10B. If the wavelength of the ripple and other parameters are taken into consideration, however, the ripple reducing device still yields a satisfactory effect even if the side branch is provided outside the pump as in the first embodiment of FIG. 2A. For example, where the ripple frequency is 200 Hz, and the sound velocity within the line is 1000 m/sec., the interval between adjacent antinodes is equal to 2.5 m, and therefore the side branch provides a sufficient ripple reducing effect if its branch point is located in the range of several tens of centimeters from the valve plate of the pump.

INDUSTRIAL APPLICABILITY

While hydraulic pumps are illustrated in the first through fourth embodiments, the present invention is not necessarily applied to the hydraulic pumps, but may be applied to other actuators utilizing hydraulic pressure, such as those used in construction machines. Namely, the present invention maybe applied to all situations where hydraulic systems suffer from ripple.

What is claimed is:

1. A ripple reducing device for reducing the ripple of oil flowing through a hydraulic line, comprising:

a closed line that diverges from the hydraulic line, and is closed at a terminal end thereof; and at least one restrictor that divides an interior of said closed line into a plurality of sections, between a branch point at which said closed line diverges from the hydraulic line and said terminal end, so that transmission loss takes relative maximum values at a plurality of frequencies.

2. A ripple reducing device as defined in claim 1, wherein an inside diameter of said closed line, a length of each of said plurality of sections, and characteristics of said at least one restrictor are determined so that transmission loss takes relative maximum values at least at a fundamental frequency and secondary harmonic of the ripple.

3. A ripple reducing device as defined in claim 1, wherein said at least one restrictor comprises of one restrictor by which said closed line is divided into two sections, and wherein an inside diameter of said closed line, a length of each of said two sections, and characteristics of said one restrictor are determined so that transmission loss takes relative maximum values at a fundamental frequency and secondary harmonic of the ripple.

4. A ripple reducing device as defined in claim 1, wherein said at least one restrictor comprises two restrictors by which said closed line is divided into three sections, and wherein an inside diameter of said closed line, a length of each of said three sections, and characteristics of said two restrictors are determined so that transmission loss takes relative maximum values at a fundamental frequency, secondary harmonic and third harmonic of the ripple.

5. A ripple reducing device as defined in claim 1, wherein said closed line comprises one line, and each of said at least one restrictor comprises a member that is inserted in an interior of said closed line, and fixed at a predetermined position.

6. A ripple reducing device for reducing the ripple of oil flowing through a hydraulic line, comprising:

a closed line that diverges from the hydraulic line, and is closed at a terminal end thereof, wherein said closed line comprises at least two lines and a joint member inserted between said at least two lines so as to provide a restrictor, so that transmission loss takes relative maximum values at a plurality of frequencies, said joint member having an inside diameter different from that of said closed line.

7. A ripple reducing device as defined in claim 6, wherein the restrictor is a choke restrictor.

8. A hydraulic pump capable of reducing ripple of oil discharged from the pump, comprising:

a main hydraulic line that leads the oil to a delivery port;

a closed line that diverges from said main hydraulic line, and is closed at a terminal end thereof; and at least one restrictor that divides an interior of said closed line into a plurality of sections, between a branch point at which said closed line diverges from said main hydraulic line, and the terminal end of said closed line, wherein at least a part of said plurality of sections is provided inside the hydraulic pump.

9. A hydraulic pump as defined in claim 8, wherein said closed line includes a replaceable portion that is located outside the hydraulic pump.

* * * * *

UNITED STATES PATENT AND TRADEMARK OFFICE

CERTIFICATE OF CORRECTION

PATENT NO. : 6,116,872

DATED : September 12, 2000

INVENTOR(S) : Seiichiro Takeshita and Eiichi Kojima

It is certified that error appears in the above-identified patent and that said Letters Patent is hereby corrected as shown below:

ON THE TITLE PAGE

Item [30] Foreign Application Priority Data please change "Feb. 4, 1997" to --April 2, 1997--.

Signed and Sealed this

Eighth Day of May, 2001

Nicholas P. Godici

*Attest:*

NICHOLAS P. GODICI

*Attesting Officer*

*Acting Director of the United States Patent and Trademark Office*